United States Patent [19]

Surland

[11] 4,177,995

[45] Dec. 11, 1979

[54] GOLF PRACTICE DEVICE

[76] Inventor: Charles C. Surland, 12538 Parkvilla Ave., Baton Rouge, La. 70816

[21] Appl. No.: 958,043

[22] Filed: Nov. 6, 1978

Related U.S. Application Data

[63] Continuation-in-part of Ser. No. 822,382, Aug. 5, 1977, abandoned.

[51] Int. Cl.[2] ..... A63B 69/36

[52] U.S. Cl. ..... 273/199 A; 46/86 R; 273/58 C

[58] Field of Search ..... 273/106 B, 106 F, 199 R, 273/199 A, 200 R, 183 C, 58 C; 46/86 R

[56] References Cited

U.S. PATENT DOCUMENTS

| | | | |
|---|---|---|---|
| 2,141,250 | 12/1938 | Perrault | 273/199 A |
| 2,634,982 | 4/1953 | Gaede | 273/106 B |
| 3,147,979 | 9/1964 | Wolfe | 273/199 A |
| 3,627,326 | 12/1971 | Berry | 273/183 C |
| 3,697,081 | 10/1972 | Peyroux | 273/199 A |
| 3,710,505 | 1/1973 | Linenfelser | 273/106 B X |

FOREIGN PATENT DOCUMENTS

| | | | |
|---|---|---|---|
| 1495597 | 8/1967 | France | 273/199 A |
| 92791 | 11/1968 | France | 273/199 A |
| 11380 | of 1892 | United Kingdom | 273/199 A |
| 19786 | of 1908 | United Kingdom | 273/200 R |

*Primary Examiner*—George J. Marlo

*Attorney, Agent, or Firm*—Allegretti, Newitt, Witcoff and McAndrews

[57] ABSTRACT

A drag member having a flexible, self-sustaining form is centrally attached to a golf ball by a flexible elongated member. The drag member comprises a substantially planar central portion and radial segments extending outwardly from the central portion. When the golf ball is driven through the air, the drag member is pulled behind the ball transverse to the trajectory of the ball. The drag member defines an aerodynamically designed drag surface area of initially fixed dimensions which vary inversely with the flight speed of the device. The drag member acts to shorten the flight of the golf ball and to provide a flight trajectory for the attached golf ball similar to that of a conventional golf ball.

7 Claims, 5 Drawing Figures

GOLF PRACTICE DEVICE

BACKGROUND OF THE INVENTION

This is a continuation-in-part of application Serial No. 822,382, filed August 5, 1977, now abandoned.

In a principal aspect, this invention relates to an improved golf practicing device and more particularly to a golf ball having an aerodynamically designed drag member of self-sustaining form attached thereto.

Golfers frequently desire to practice their golf swing in backyards or other relatively small spaced environments. Unfortunately, the available golf practice devices do not realistically simulate the "feel" of driving a golf ball on a fairway and the flight trajectory of a golf ball after being driven, thus denying the golfer two important criteria to judge the development of his swing. For example, conventional golf practice devices include plastic spheres approximately the size of a standard golf ball which are hollow and very lightweight. These devices provide neither the "feel" nor the flight trajectory that a person observes driving a conventional golf ball. Other known golf practice devices include a conventional golf ball attached to a small, convention type of cloth parachute. When the ball is hit the parachute is supposed to open and slow the flight of the ball. Too frequently, the parachute will fail to open, or will only partially open, thus raising the potentional of damage to property. Furthermore, even when the parachute does open, the flight characteristics of the conventional type of parachute may significantly distort the flight trajectory of the ball, particularly if the ball is driven at a high rate of speed. To overcome these disadvantages and provide an improved golf practice device, the subject matter of the present invention was devised.

BRIEF SUMMARY OF THE INVENTION

In principal aspect, the improved golf practice device of the present invention includes a conventional type golf ball, a drag member for resisting rapid movement of the golf practice device through the air, and a member for attaching the golf ball and the drag member. Specifically, the invention includes an aerodynamically designed drag member which is attached to the ball in such a way that its ability to slow the flight of the golf practice device is not dependent on a change in the physical shape of the drag member triggered by an air flow past the device. The drag member includes a substantially planar central portion and radial segments extending outwardly from the central portion, with both the central portion and the segments being made of a flexible material having sufficient inherent rigidity to provide a self-sustaining form and for resisting rapid movement of the golf practice device through the air. The attaching member includes an elongated and flexible cord, advantageously made of a material having a high tensile strength. One end of the cord is centrally attached to a first, planar surface of the drag member and extends transversely from the drag member. The other end of the cord is attached to a conventional golf ball.

When the golf ball is driven through the air, the drag member is pulled behind the ball by the attaching means in such a way that the first planar surface of the drag member is substantially transverse to the trajectory of movement of the golf practice device. Thus, the drag member projects a surface area in the plane tranverse to the flight trajectory of the ball which resists rapid movement of the golf practice device through the air. The dimensions of this surface area are relatively fixed initially, being substantially equal to the surface area of the first planar surface of the drag member to which the attaching member is connected. That is, in the absence of external forces, the self-sustaining qualities of the material which form the drag member impart relatively fixed dimensions to the shape of the member.

As noted, the drag member may advantageously be constructed with a central portion and radial segments extending outward from the central portion. Although the exact mechanism by which this construction operates is not fully understood, the radial segments improve the aerodynamic characteristics of the golf practice device by adding to stability of the practice device in flight, reducing lateral fluttering and generally further improving simulation by the golf practice device of the flight trajectory of a conventional golf ball free of attaching devices. The segments are believed to increase the flexibility of the drag member causing it to bend at its outer edges, or to deform in a conical shape, under the forces created by air resistance as when the practice device is driven through the air. This deformation causes variation in the amount of surface area projected by the drag member into a plan transverse to flight trajectory of the ball, the variation being inverse with the speed of the golf practice device relative to the air. The radial segments additionally define air passageways which are believed to accommodate and channel an air flow transverse to the drag member.

Thus it is an object of the present invention to provide a golf practice device which reduces the flight distance of a normal golf ball, provides the "feel" of hitting a normal golf ball and simulates the flight trajectory of a conventional golf ball.

Another object of the present invention is to provide a golf practice device having a drag or air resisting member of essentially self-sustaining form, or a form which is not dependent on a change in shape being triggered by movement of the device relative to the air.

It is also an object of the present invention to provide a golf practice device having a drag member which presents an air resisting surface of dimensions which vary in relation to the flight speed of the device, thereby improving stability of the device when in flight.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 generally illustrates the relative dimensions of the attaching device, the golf ball and the planar member.

DETAILED DESCRIPTION OF THE PREFERRED EMBODIMENT

Referring to FIGS. 1–4, the preferred embodiment of the golf practice device of the present invention is generally shown as 10. The device 10 includes a golf ball 12 and a generally circular, substantially planar drag member 14 which is attached to the golf ball 12 by an elongated, flexible cord 16. The golf ball 12 is generally of a substantially conventional construction.

Figure 1:
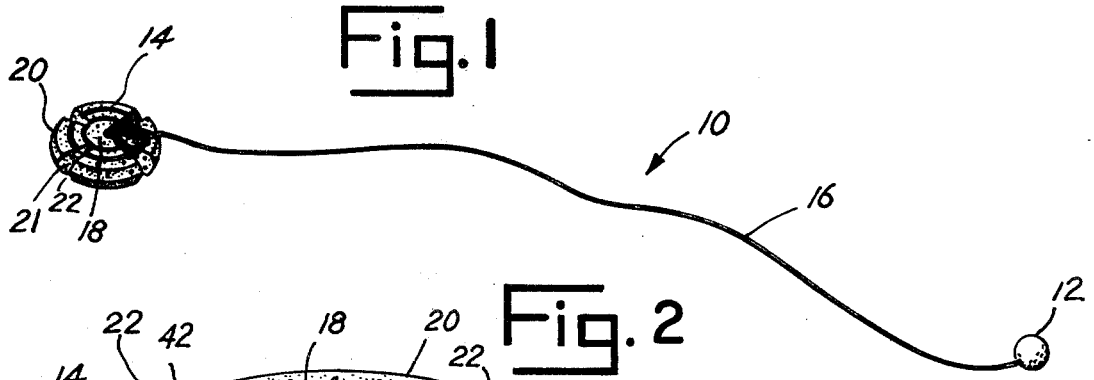
FIG. 1 shows the golf practice device according to this invention.
Figure 2:
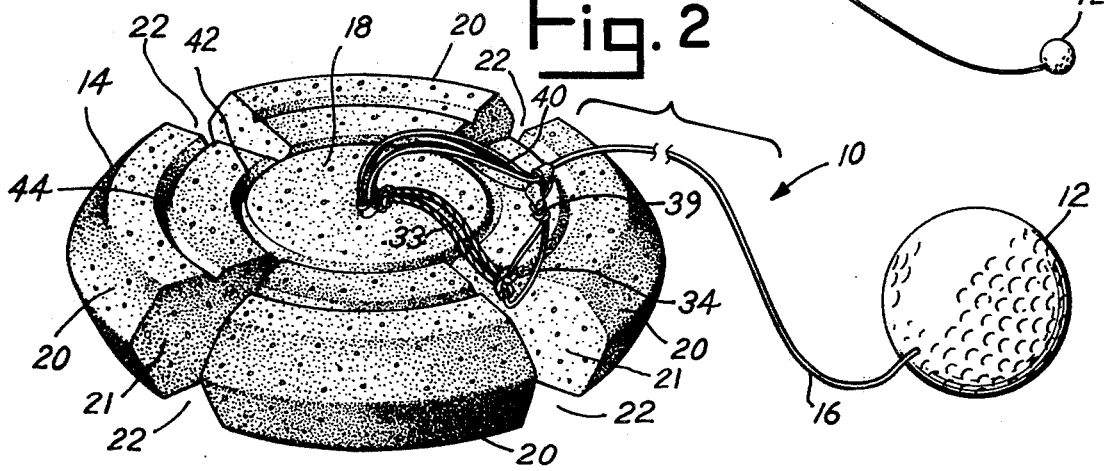
FIG. 2 shows an enlarged perspective view of the drag member and golf ball.
Figure 3:
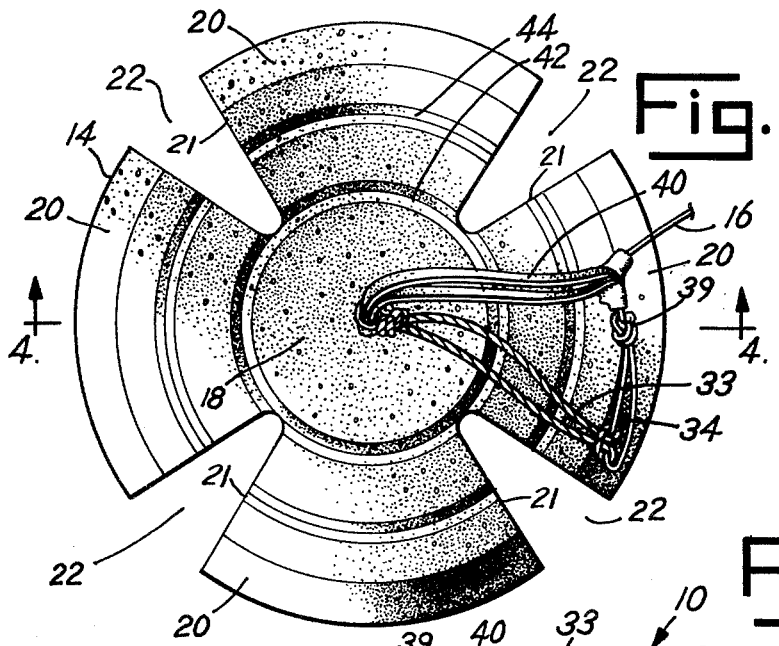
FIG. 3 shows a top view of the drag member and attaching means.
Figure 4:
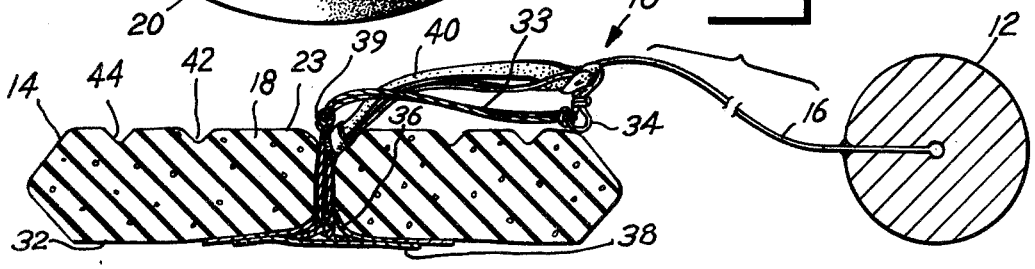
FIG. 4 shows a cross-sectional view of the drag member and the golf ball.

Referring to FIGS. 2–4, the circular, planar drag member 14 includes a central portion 18 with radial segments 20 projecting outwardly therefrom. The central portion 18 and radial segments 20 are advantageously integrally molded of a plastic material with sufficient inherent rigidity to provide self-sustaining form. The surface 23 of drag member 14, and thus of the central portion 18 and the segments 20, is substantially flat.

The radial segments 20 are preferably four in number spaced equally around the outer periphery of central portion 18. Radial surfaces 21 of the segments 20 define air passageways 22 extending between adjacent radial segments 20 outwardly from the central portion 18. These air passageways 22 are believed to channel and accommodate an air flow passing transverse to the drag member 14, such as the air flow produced when the golf practice device 10 is driven through the air by a golfer.

As noted above, the drag member 14 is connected with golf ball 12 by a flexible, elongated cord 16. As shown in FIGS. 3 and 4, one end of the cord 16 is embedded within the golf ball 12. A particularly advantageious method of embedding the end of cord 16 in the ball 12 is to drill a hole to the center of golf ball 12, tie the end of cord 12 into a knot, coat this knot with an epoxy resin and force it into the hole hollowed out to be larger in diameter than the passage of the hole to center. The hole is also hollowed near the surface of the ball to form a flaired passage entry. The remainder of the hole is then filled with an elastic compound to prevent sharp bends and reduce abrasion between the ball 12 and the cord 16.

The other end of the flexible cord 16 is tied securely into a loop 34. A shorter cord 33 is passed transversely through the center of central portion 18 so that both ends of the shorter cord 33 lie above the planar surface 23. The ends of the shorter cord 33 are tied to the loop 34 on cord 16. As shown in FIG. 4, a reinforcing member 36 is advantageously placed on a surface 32 of central portion 18 between the drag member 14 and the shorter cord 33 to prevent shorter cord 33 from tearing through the drag member 14 when the practice device 10 is driven through the air. Also as shown in FIG. 4, a second pad 38 is preferably placed over the cord 33, adjacent to the member 36, so as to enhance the appearance of the attachment of cord 33 with planar drag member 14. Also as shown in FIG. 4, a knot is advantageously made in the short cord 33 near the planar surface 23 of drag member 14. One end of a short, elastic cord 40 is fastened onto the short cord 33 between the knot 39 and the drag member 14. The other end of the elastic member 40 is attached to the elongated cord 16 between the loop 34 and golf ball 12. The elastic member 40 has a length which is less than the distance between the knot 39 and loop 34 so that the elastic member 40 is adapted to reduce the initial strain or pulled exerted by elongated cord 16 on the planar member 14 when golf ball 12 is driven through the air. Additionally the elastic cord 40 provides an alternative means of connection between the knot 39 and the loop 34 in the event that either loop 34 or the short cord 33 fail.

The dimensions of the central portion 18 and the radial segments 20 of the drag member 14 are dependent somewhat on the particular material which is used to form those components of the member 14. The central portion 18 should have sufficient strength perpendicular to the surface 23 of the member 14 to withstand the strain experienced by the member 14 when golf ball 12 is driven through the air. The thickness of the radial segments 20 is generally equal to that of the central portion 18. The surface area of a planar surface 23 of member 14 must be large enough to produce a resisting force which is effective in decelerating and shortening the flight of the golf practice device 10. As will be seen shortly, this area is somewhat dependent on the flexibility and porosity of the material used to manufacture member 14. In preferred form, the surface 38 member has a diameter of about five inches.

Figure 5:
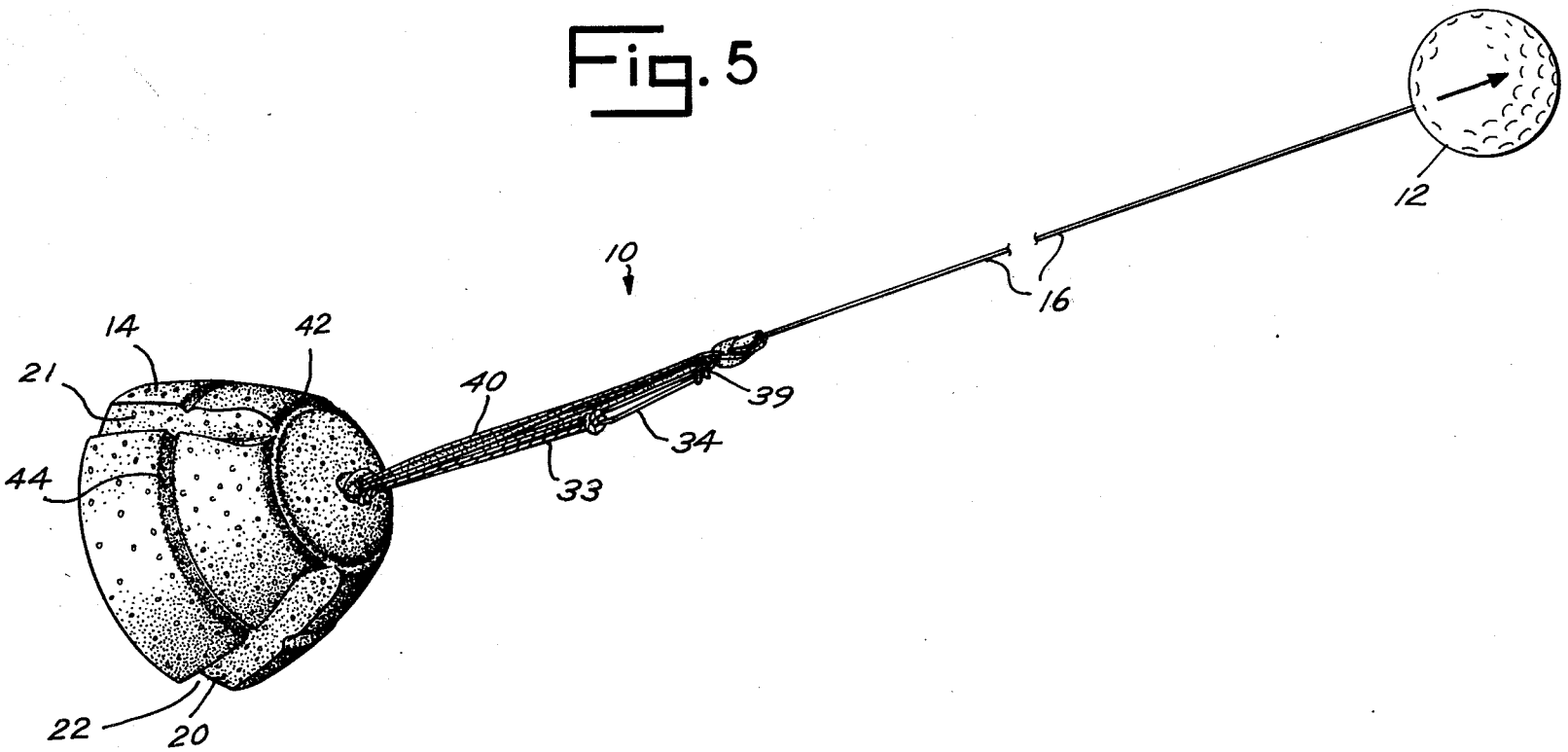
FIG. 5 shows a perspective view of the invention in flight.

When the golf ball 12 of the golf practice device 10 is driven through the air, the member 14 is moved rapidly through the air with planar surface 23 generally transverse to the trajectory of movement. The resistance of surface 23 to the air creates forces which bend the radial segments 20 so as to deform the shape of the member 14 into a somewhat conical shape and so as to vary the amount of surface area of surface 23 projected transversely to the direction of movement of the member 14. As stated previously, experimentations have shown that this surface area varies inversely with the speed on the golf practice device 10 relative to the air. The deformation of member 14 together with the air streams created by air passageways 22 are believed to impart aerodynamic control characteristics which reduce lateral fluttering of the golf practice device, as shown in FIG. 5.

Drag member 14 may advantageously be formed from an open celled, foam plastic material characterized in that the plastic material forms a plurality of cell walls and cell units, the cells being interconnected to define minute air passageways transversely through planar member 14. This structure is believed to aid the stability and smooth flight characteristics of the drag member by providing additional channels to accommodate and direct a smooth flow of air transverse to the member 14.

The drag member 14 advantageously includes a plurality of grooves in its planar surface 23. A first circular groove 42 is formed in planar surface 23 of the central portion 18, concentric with and about the central, transverse axis of the member 14, as shown in FIG. 2. Arcuate grooves 44, also concentric to central transverse axis of the member 14, are formed in the planar surface 23 of the central portion 18 and serve to define the radially inner edge of the segments 20. These grooves 42, 44 are believed to increase the flexibility of the planar member 14 and thereby aid aerodynamic stability.

In an alternative embodiment the drag member 14 is formed of a closed cell foamed material. The air which is trapped within the closed cells imparts buoyancy to the golf practice device such that it floats on water. Thus, this embodiment is particularly advantageous when the golf practice device is to be used along a beach or near any body of water.

The above description relates to the preferred embodiment of the invention. The preferred configuration is described and illustrated in the drawing. However, alternate configurations and modifications are possible within the scope of the drawing. For example, different dimensions and shapes of the disc, the grooves and the cutouts are possible. The number and dimension of radial segments may be changed. Therefore, the subject matter of this invention is to be limited only by the following claims and their equivalents.

What is claimed is:

1. A golf practice device, comprising, in combination:

(a) a golf ball;

(b) a substantially planar drag member, said planar drag member being formed of a flexible material providing a self-sustaining form and having a central portion and a plurality of radial segments extending outward from said central portion, said segments defining means for accommodating and channeling an air-flow transverse to said planar drag member and for causing said planar drag member to deform in a substantially conical shape in response to an air flow transverse to said planar drag member;

(c) means for attaching said planar drag member to said golf ball, said attaching means comprising a flexible elongated member attached centrally to a first, planar surface of said planar drag member and extending from said planar surface in a direction transverse to said planar member, said planar member being pulled behind said golf ball by said attaching means to define means for presenting immediately upon movement of said ball a surface area which resists air movement substantially transverse to the flight trajectory of said golf ball; and (d) said planar member, said attaching means and said golf ball cooperating to define means for varying said surface area inversely with the speed of movement of said golf practice device through the air.

2. A golf practice device as claimed in claim 1 wherein said means for varying said surface area further includes:

(a) a first circular groove in said first planar surface of said planar drag member, said first circular groove positioned on said central portion and substantially concentric to a center of said central portion; and (b) arcuate grooves lying in said first planar surface of said planar member, at least one said arcuate groove positioned on each said radial segments.

3. A golf practice device as claimed in claim 1 wherein said planar member is formed of an open celled, foamed plastic material.

4. A golf practice device as claimed in claim 1 wherein said flexible elongated member has a first location and a second location, said attaching means further comprising, an elastic member attached between said first and second locations, and said elastic member having a length which is less than the length of said elongated member between said first and second locations, said elastic member defining means for reducing the initial strain exerted on the drag member initially after said golf ball has been driven through the air and for providing an alternative connection between said first and second locations on said flexible elongated member if said elongated member separates between said first and second locations.

5. A golf practice device as in claim 1 wherein said planar member is formed of a closed cell foamed plastic material such that said golf practice device floats on water.

6. A golf practice device as in claim 1 wherein a hole is located within said ball, said hole having a hollowed center to receive said flexible elongated member and a passage to said center, said hollowed out center being larger than said passage.

7. A golf practice device as in claim 6 wherein said hole has an entry, said hole being hollowed out near said entry to define a flaired portion, said passage being filled with elastic material, said flaired portion and said elastic material cooperating to prevent sharp bends and to reduce abrasion of said flexible elongated member when said golf practice device is driven through the air.

* * * * *